US005528921A

United States Patent [19]

Herman

[11] Patent Number: 5,528,921

[45] Date of Patent: Jun. 25, 1996

[54] TUBE BENDING APPARTUS

[76] Inventor: Fred L. Herman, P.O. Box 1814, Alvin, Tex. 77512-1814

[21] Appl. No.: 238,011

[22] Filed: May 3, 1994

[51] Int. Cl.[6] ..... B21D 7/08

[52] U.S. Cl. ..... 72/389.1; 72/213; 72/389.6

[58] Field of Search ..... 72/212, 213, 389

[56] References Cited

U.S. PATENT DOCUMENTS

| | | | |
|---|---|---|---|
| 3,400,565 | 9/1968 | Morris | 72/213 |
| 3,918,286 | 11/1975 | Whitehead | 72/213 |
| 4,004,445 | 1/1977 | Larson | 72/389 |
| 4,485,664 | 12/1984 | Richards | 72/212 |

*Primary Examiner*—David Jones
*Attorney, Agent, or Firm*—Kenneth A. Roddy

[57] ABSTRACT

A tube bending apparatus has an elongate frame with a longitudinal slot in an upper surface thereof and removal rollers laterally spaced at each side of the slot above the upper surface. A rolling carriage and reciprocating ram are disposed beneath the upper surface. A vertical post secured to the carriage has an upper end extending through the slot and a reversible bending die is removably mounted on the upper end of the post above the upper surface of the frame. The bending die is advanced and retracted relative to the lateral rollers by the ram such that a section of a tubular workpiece held against said lateral rollers can be engaged by the bending die and bent into a curved configuration. The lateral rollers and bending die above the upper surface and the reciprocating axis beneath the upper surface provide a substantially unobstructed area around the rollers and bending die through which at least one free end of the workpiece may pass when being bent whereby a plurality of adjacent bends lying in the same plane or different planes may be made without a previously bent section striking the rollers, bending die, or ram. The bending die has a peripheral opening to receive a previously bent section for making transition bends, and in combination with a backup tool receives the nut and sleeve of a flared fitting for making bends very close to a flared fitting. An indicator disk may be installed on one roller to indicate springback.

7 Claims, 8 Drawing Sheets

10
11
12
13
14
15
16
17
18A
19A
24
26
27
28
29
30
35
36
39B
40
42
2

10
11
12
13
14
16
16A
17
18B
19B
21
22
24
26
27
28
29
30
31
32
33
34,38
35
36
39A
39B
40

TUBE BENDING APPARTUS

BACKGROUND OF THE INVENTION

1. Field of the Invention

This invention relates generally to tube bending apparatus and methods, and more particularly to a tube bending apparatus having an elongate frame with lateral rollers on an upper surface and a feeding carriage and reciprocating ram disposed beneath the upper surface that moves a reversible bending die and backup tool along the upper surface relative to the lateral rollers, which provides a substantially unobstructed bending plane and allows very close successive bends to be made in the workpiece including transition bends and bends very close to a flared fitting and nut.

2. Brief Description of the Prior Art

Apparatus for bending pipes, tubes, and rods, generally comprise an elongate frame having a power means such as a drive screw or hydraulic ram mounted lengthwise on the frame with a curved forming die or bending shoe mounted on the end of the piston rod and a pair of cylindrical stop members or rollers secured on the frame transverse to the longitudinal axis of the power means. The tubular workpiece is held against the stops or rollers and the power means pushes against the center portion of the workpiece between the stops or rollers to form a bend in the workpiece.

Many conventional bending machines place the pushing apparatus in the bending plane of the workpiece which makes it difficult or impossible to bend a workpiece adjacent an already bent section, because the end of the previously bent section tends to strike the frame or the pushing apparatus. Another problem with conventional pipe bending apparatus is that the diameter of the pipe, tubing, or rod may be in inches or may be metric, in which case, the user would have to calculate the spacing of the stops or rollers and reposition different diameter rollers and bending shoe die members to accommodate the diameter of the respective workpiece.

Another common problem with conventional roller members and a curved forming die is that it is extremely difficult to form a bend very close to the end of a section of tubing which has a sleeved flared fitting and nut because the nut will not fit closely against the curved surfaces of the rollers and the forming die. In other words, the nut must be positioned outwardly beyond the radius of the curved surface of the rollers or forming die. Another problem commonly encountered with hydraulically powered bending machines, is that with many workpiece materials there is a tendency for the bent tubing or rod to "springback" after the hydraulic pressure is released, resulting in less accuracy of the finished bend angle.

There are several patents which disclose various apparatus for bending pipes, tubes, and rods which have a power means mounted lengthwise on a frame and utilize a curved forming die or bending shoe to push against the center portion of the workpiece between stops or rollers to form a bend in the workpiece.

Owens, U.S. Pat. No. 5,237,847 discloses a tube bending apparatus having a specially designed bending shoe which is configured to prevent crimping on small tubes during bending. The apparatus includes frame with a pair of angular slots on each side of the longitudinal axis of the power means and a pair of lateral rollers adjustably mounted in the slots. The rollers have a circumferential channel which is semi-circular in vertical cross section defining radial lips at the top and bottom of the channel. The specially designed bending shoe is a generally U-shaped member having a peripheral channel, semi-circular in vertical cross section, with a curved center portion and a pair of parallel lateral side portions having lips at the top and bottom of the peripheral channel. The lips on the lateral side portions of the bending shoe meet the lips on the lateral rollers to form a circle around the workpiece, but the lips of the curved center portion of the bending shoe extend beyond the center of the workpiece to prevent vertical expansion of the side wall of the tubular workpiece during a bend.

Schwarze, U.S. Pat. No. 4,788,845 discloses a pipe bending machine having a rotatable bending head at one end of the frame that has a plurality of vertical spaced bending grooves. A clamping jaw pivotally mounted on a longitudinally movable carriage slides angularly upward to clamp the pipe between the pivotal jaw and a selected bending groove of the bending head.

Sterghos, U.S. Pat. No. 4,788,847 discloses a rod bending machine having a longitudinally movable bending die which passes between a pair of lateral roller dies mounted on laterally spaced arms pivotally attached to the top of the frame wherein the movement of the bending die simultaneously effects movement of the two arms which support the lateral roller dies to bend the rod positioned between the bending die and lateral rollers.

Whitehead, U.S. Pat. No. 3,918,286 discloses a U-bolt bending machine having a longitudinally movable bending die which passes between a pair of roller dies mounted on laterally spaced arms pivotally attached to the top of the frame wherein the lateral spacing of the roller dies are adjusted by means of a threaded rod which extends transversely between the pivoting arms across the top of the frame.

Ware, U.S. Pat. No. 3,908,425; Goldberg, U.S. Pat. No. 4,005,593; Kelly, U.S. Pat. No. 4,254,651: Grimaldo, U.S. Pat. No. 4,833,907; and McMaster, U.S. Pat. No. 4,265,106 disclose various tube or pipe bending machines having a longitudinally movable bending die which bends the pipe or tube between stop members wherein the pushing apparatus lies in the same plane as the bending plane of the workpiece which makes it difficult or impossible to bend a workpiece adjacent an already bent section.

The present invention is distinguished over the prior art in general, and these patents in particular by a tube bending apparatus which has an elongate frame with a longitudinal slot in an upper surface thereof and removal rollers laterally spaced at each side of the slot above the upper surface. A rolling carriage and reciprocating ram are disposed beneath the upper surface. A vertical post secured to the carriage has an upper end extending through the slot and a reversible bending die is removably mounted on the upper end of the post above the upper surface of the frame. The bending die is advanced and retracted relative to the lateral rollers by the ram such that a section of a tubular workpiece held against said lateral rollers can be engaged by the bending die and bent into a curved configuration. The lateral rollers and bending die above the upper surface and the reciprocating axis beneath the upper surface provide a substantially unobstructed area around the rollers and bending die through which at least one free end of the workpiece may pass when being bent whereby a plurality of adjacent bends lying in the same plane or different planes may be made without a previously bent section striking the rollers, bending die, or ram. The bending die has a peripheral opening to receive a previously bent section for making transition bends, and in combination with a backup tool receives the nut and sleeve of a flared fitting for making bends very close to a flared fitting. An indicator disk may be installed on one roller to indicate springback.

SUMMARY OF THE INVENTION

It is therefore an object of the present invention to provide an apparatus for bending pipes, tubes, and rods, which allows successive bends to be formed in the workpiece without the end of a previously bent section striking the frame or the pushing device.

It is another object of this invention to provide an apparatus for bending pipes, tubes, and rods, which allows quick, easy, and accurate positioning of cylindrical stop members or rollers to accommodate various diameters of either inch or metric diameter workpieces.

Another object of this invention is to provide an apparatus for bending pipes, tubes, and rods, which makes it possible to form a bend very close to the end of a section of tubing which has sleeved flared fitting and nut installed thereon.

A further object of this invention is to provide an apparatus for bending pipes, tubes, and rods, which has a device for indicating the amount of springback of the workpiece after a bend has been made so that the workpiece can be bent to an extremely accurate bend angle.

A still further object of this invention is to provide an apparatus for bending pipes, tubes, and rods, which is simple in construction, economical to manufacture, and reliable in operation.

Other objects of the invention will become apparent from time to time throughout the specification and claims as hereinafter related.

The above noted objects and other objects of the invention are accomplished by a tube bending apparatus which has an elongate frame with a longitudinal slot in an upper surface thereof and removal rollers laterally spaced at each side of the slot above the upper surface. A rolling carriage and reciprocating ram are disposed beneath the upper surface. A vertical post secured to the carriage has an upper end extending through the slot and a reversible bending die is removably mounted on the upper end of the post above the upper surface of the frame. The bending die is advanced and retracted relative to the lateral rollers by the ram such that a section of a tubular workpiece held against said lateral rollers can be engaged by the bending die and bent into a curved configuration. The lateral rollers and bending die above the upper surface and the reciprocating axis beneath the upper surface provide a substantially unobstructed area around the rollers and bending die through which at least one free end of the workpiece may pass when being bent whereby a plurality of adjacent bends lying in the same plane or different planes may be made without a previously bent section striking the rollers, bending die, or ram. The bending die has a peripheral opening to receive a previously bent section for making transition bends, and in combination with a backup tool receives the nut and sleeve of a flared fitting for making bends very close to a flared fitting. An indicator disk may be installed on one roller to indicate springback.

DESCRIPTION OF THE PREFERRED EMBODIMENT

Figure 1:
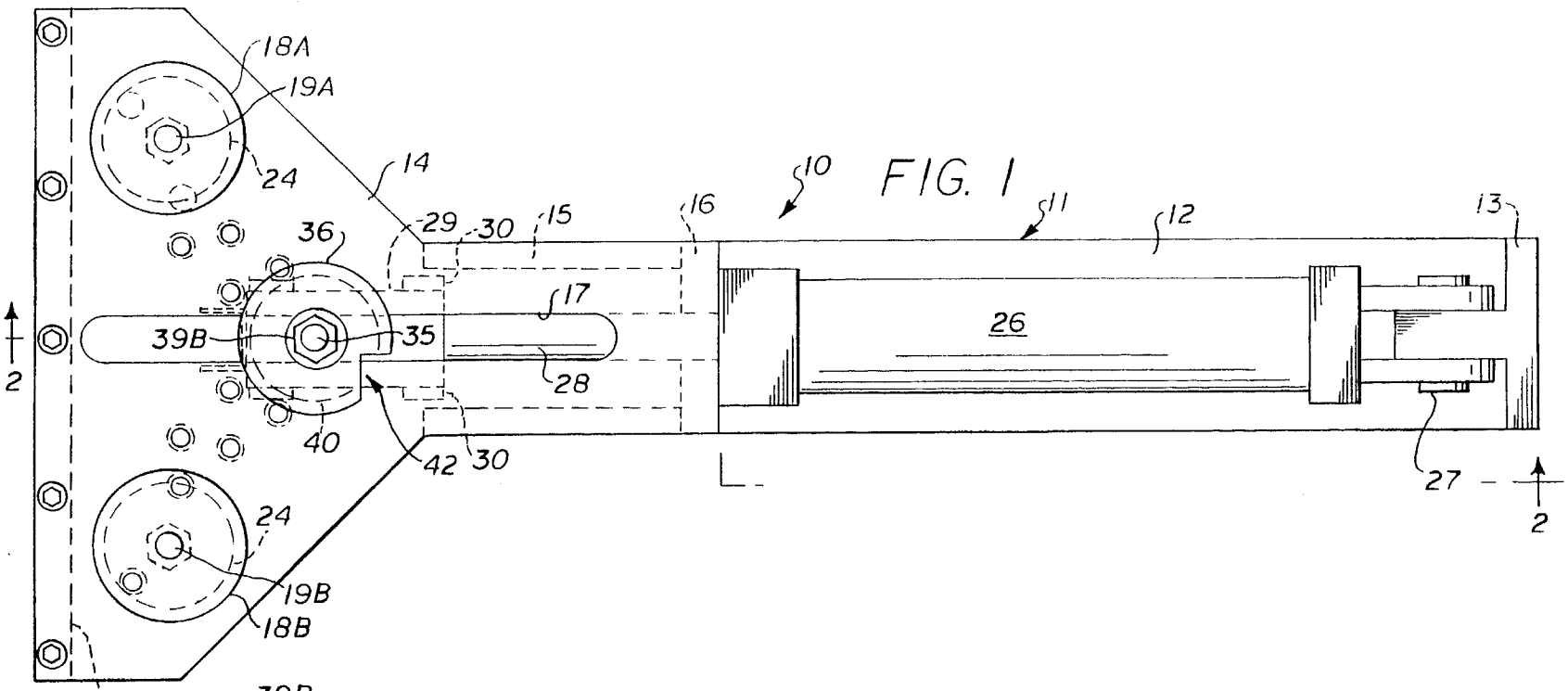
FIG. 1 is a top plan view of the pipe bending apparatus in accordance with the present invention.
Figure 2:
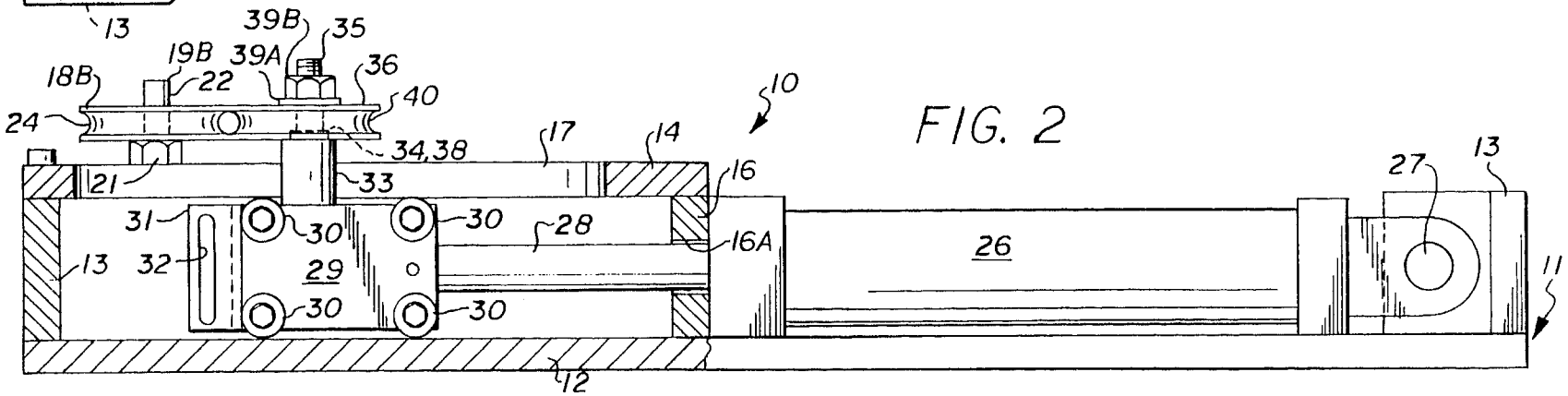
FIG. 2 is a side elevation of the pipe bending apparatus taken along line 2—2 of FIG. 1.

Referring to the drawings by numerals of reference, there is shown in FIGS. 1 and 2, a preferred pipe bending apparatus 10. In the following discussion, the left-hand end of the apparatus as seen in FIG. 1 will be referred to as the forward end and the right-hand end will be referred to as the rearward end. The pipe bending apparatus has an elongate frame 11 having a bottom plate 12, end plates 13, and a top plate 14 secured a distance above the bottom plate and parallel thereto by side plates 15 and an intermediate plate 16. Intermediate plate 16 has an aperture 16A therethrough.

Figure 3:
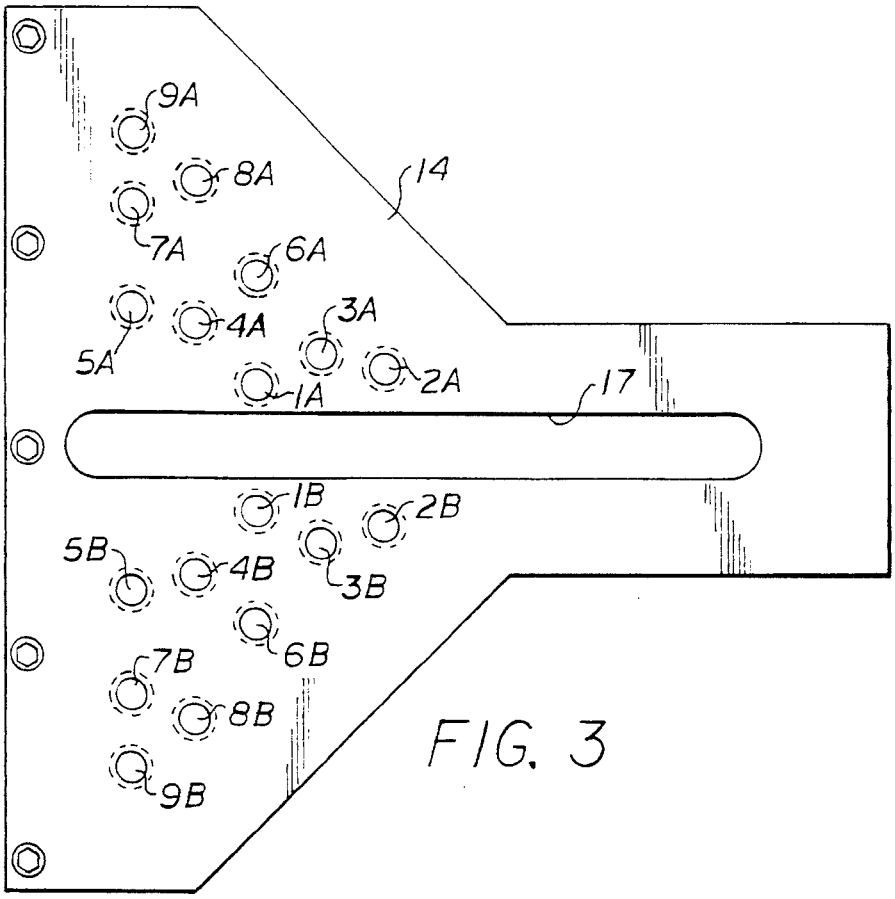
FIG. 3 is a top plan view of the top plate of the frame.
Figure 4:
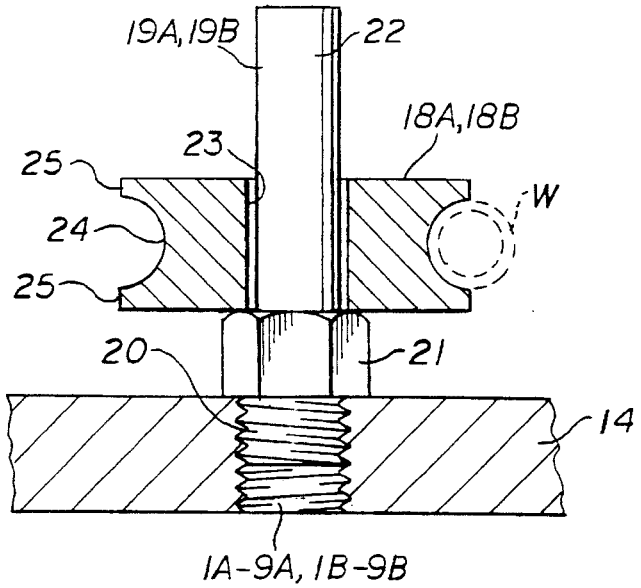
FIG. 4 is a vertical cross section through a lateral roller member of the tube bending apparatus.

As best seen in FIGS. 3 and 4, the top plate 14 has a central slot 17 extending along its longitudinal axis. A pair of sets of threaded holes identified by numerals 1A–9A and 1B–9B are formed in the top plate 14 on each side of the longitudinal slot 17 near the forward end of the slot. Each hole in the set 1A–9A is positioned laterally across from the corresponding numbered hole in the set 1B–9B. The spacing of the centers of the sets of holes is calculated to accurately mount a pair of lateral rollers 18A and 18B.

A pair of vertical pins 19A and 19B each having a threaded bottom end 20, a hexagonal intermediate portion 21 and a reduced diameter upper portion 22 are threadedly engaged in a corresponding laterally spaced pair of holes (1A–9A and 1B–9B) in the top plate 14.

The lateral rollers 18A and 18B are circular members having a central bore 23. The lateral rollers 18A and 18B are rotatably mounted in a horizontal plane on the reduced diameter upper portion 22 of the vertical pins 19A and 19B by sliding their central bore 23 onto the upper portion 22 of the vertical pins. As best seen in FIG. 4, the lateral rollers 18A and 18b have an annular circumferential concave channel 24 which is semi-circular in vertical cross section defining circumferential lips 25 at the top and bottom of the channel. The inward facing radius of the channel 24 is sized to receive the exterior surface of a tubular workpiece W and the lips 25 do not extend beyond the vertical center line of the semi-circle forming the channel such that the channel 24 surrounds approximately one-half of the circumference of the workpiece W.

A chart (not shown) may be provided which correlates the particular diameter of both inch and metric tubular workpieces with the particular set of laterally spaced holes (1A–9A,1B–9B), and the corresponding size rollers 18A and 18B to be mounted in the holes. The rollers 18A and 18B may also be numbered to correspond to the hole numbers. Thus, the hole layout of the top plate 14 serves as a template for quickly mounting a pair of rollers at the proper spacing to produce a predetermined bend in a workpieces of either inch or metric standards.

Referring again to FIGS. 1 and 2, a power means, such as a hydraulic ram 26 is mounted lengthwise on the frame 11 between the bottom plate 12 and the top plate 14. One end of the ram 26 is mounted at the rearward end of the frame 11 by a pin 27 and the outer end of its piston rod 28 is connected to a generally rectangular block-like carriage 29. The carriage 29 has four rollers 30 rotatably mounted on its lateral sides near its top and bottom surfaces which are rotatably engaged on the vertically opposed surfaces of the bottom plate 12 and top plate 14. When the piston rod 28 is extended and retracted the carriage 29 travels on its rollers 30 between the bottom and top plates 12 and 14 beneath the slot 17 in the top plate 14.

A vertical yoke member 31 having a U-shaped transverse cross section is secured at the forward end of the carriage 29 and has a vertical slot 32 through its lateral side walls. The U-shaped yoke member 31 is used for mounting a backup tool, as described hereinafter.

Figure 5:
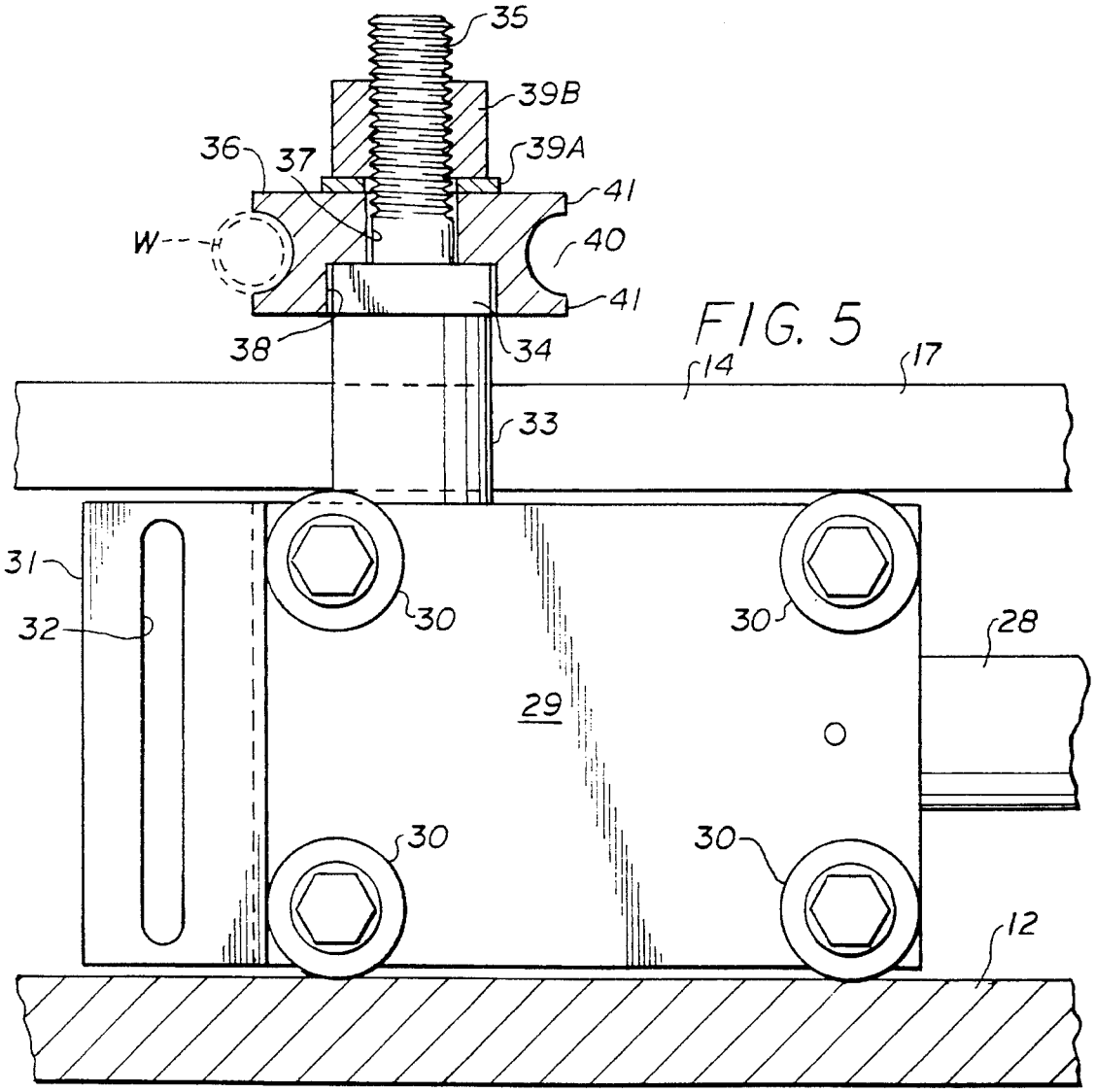
FIG. 5 is a vertical cross section through the bending die member of the tube bending apparatus.

As best seen in FIG. 5, a vertical post 33 is secured to the top of the carriage 29 and extends upwardly through the slot 17 in the top plate 14 and its upper end has a rectangular portion with flat lateral sides 34 and an externally threaded portion 35 above the rectangular portion. A generally circular bending die 36 having a central bore 37 and a shallow rectangular recess 38 on its underside is removably mounted in a horizontal plane on the upper end of the vertical post 33 by a washer 39A and nut 39B. When the piston rod 28 is extended and retracted the carriage 29 travels on its rollers 30 between the bottom and top plates 12 and 14 and moves the bending die 36 longitudinally above the top surface of the top plate 14.

The generally circular bending die 36 has an annular circumferential concave channel 40 which is semi-circular in vertical cross section defining circumferential lips 41 at the top and bottom of the channel. The inward facing radius of the channel 40 is sized to receive the exterior surface of a tubular workpiece W and the lips 41 do not extend beyond the vertical center line of the semi-circle forming the channel such that the channel 40 surrounds approximately one-half of the circumference of the workpiece W.

Figure 6:
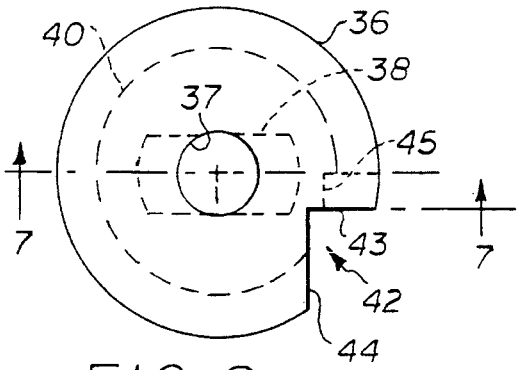
FIG. 6 is a top plan view of the bending die member.
Figure 7:
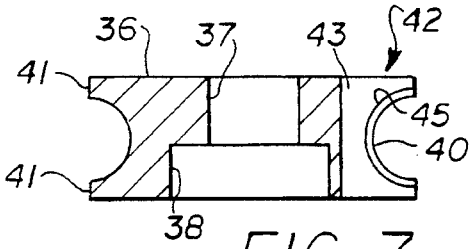
FIG. 7 is a transverse cross section through the bending die member showing the counterbore in a cut-out portion.

As seen from the top in FIG. 6 and in cross section in FIG. 7, the bending die 36 has an L-shaped cut-out portion 42 or aperture which defines a first flat surface 43 extending inwardly a distance from its outer circumference past the inward facing radius of the annular channel 40 and then a second flat surface 44 extending laterally outward to one side at a right angle to the first flat surface 43.

A counterbore 45 extends inwardly a short distance from the first flat surface 43 along an axis tangent with the center of the annular channel 40 to define a semi-circular counterbore having a radius slightly larger than the radius of the annular channel. The inward end of the counterbore 45 terminates approximately at a plane corresponding to a straight line extending the through the center of the bending die (FIG. 6).

The radius of the annular channel 40 is sized to receive one-half of the exterior diameter of the tubular workpiece W, the radius of the counterbore 45 is sized to receive one-half of the sleeve element of a flared fitting at the end of the workpiece W and the flat surface 44 of the cut-out is sized to receive the flat surface of the nut which is installed on the sleeve at the end of the workpiece. The bending die 36 may be mounted in two different positions for different operations. The rectangular recess 38 on the underside of the bending die 36 fits onto the rectangular portion 34 of the post 33 and serves as a key for positioning the cut-out portion 42 of the bending die relative to lateral rollers 18A and 18B and for reversing its position 180° to face toward the rearward end of the frame.

Figure 10:
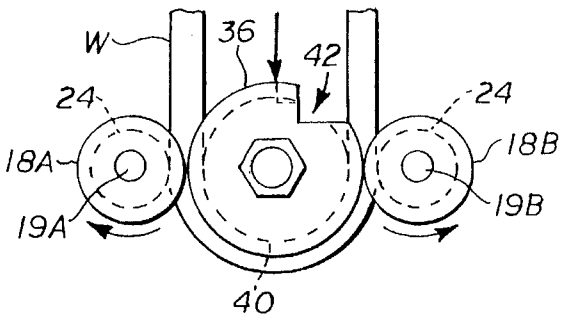
FIGS. 8, 9, and 10 are top views illustrating somewhat schematically forming a 180° bend in a workpiece.
Figure 9:
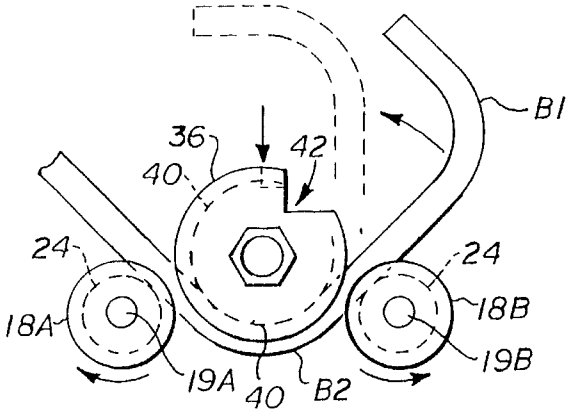
Figure 8:
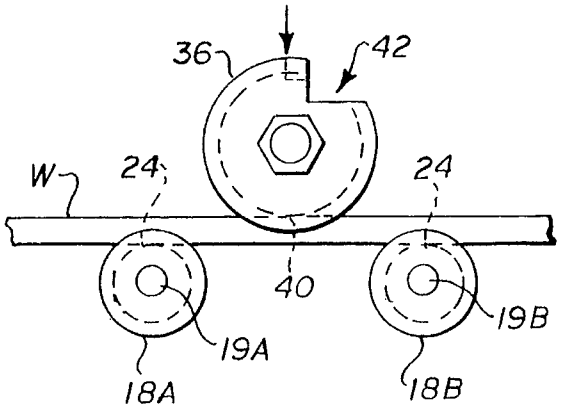

As shown somewhat schematically in FIGS. 8, 9 and 10, the bending die 36 is mounted on the post 33 with the cut-out portion 42 facing rearward (toward the ram). In this position, a tubular workpiece W is held between the lateral rollers 18A and 18B in the channels 24 and the piston rod is extended to advance the bending die 36 against the workpiece W. As the bending die 36 advances between the rollers, the workpiece is received in the channel 40 of the bending die and the workpiece W begins to bend. As the bending die advances and the workpiece W begins to bend, the rollers 18A and 18B rotate in opposite directions about the pins 19A and 19B (FIG. 9). When the bending die 36 is fully advanced between the lateral rollers, the workpiece W will have been bent a full 180° (FIG. 10). The advancement of the bending die may be stopped prior to full extension for forming bends of less than 180°.

Because only the lateral rollers 18A and 18B and the bending die 36 are disposed on top surface of the top plate 14, and the ram 26 is beneath the bending plane, there are no obstructions adjacent the rollers or bending die which would otherwise interfere with the free ends of the workpiece and make it difficult or impossible to bend a workpiece adjacent an already bent section. For example, as shown in FIG. 9, if it is desired to form a subsequent bend B2 in the workpiece adjacent the previously bent section B1, the workpiece W is held between the lateral rollers 18A and 18B in the channels 24 and the piston rod is extended to advance the bending die 36 against the workpiece. As the bending die 36 advances between the rollers, the workpiece W begins to bend. As the subsequent bend B2 is formed, the previously bent portion B1 is allowed to pass behind the bending die 36.

Figure 12:
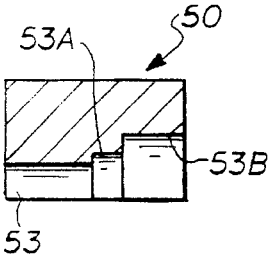
FIG. 12 is a transverse cross section through the backup tool showing a counterbored channel.
Figure 11:
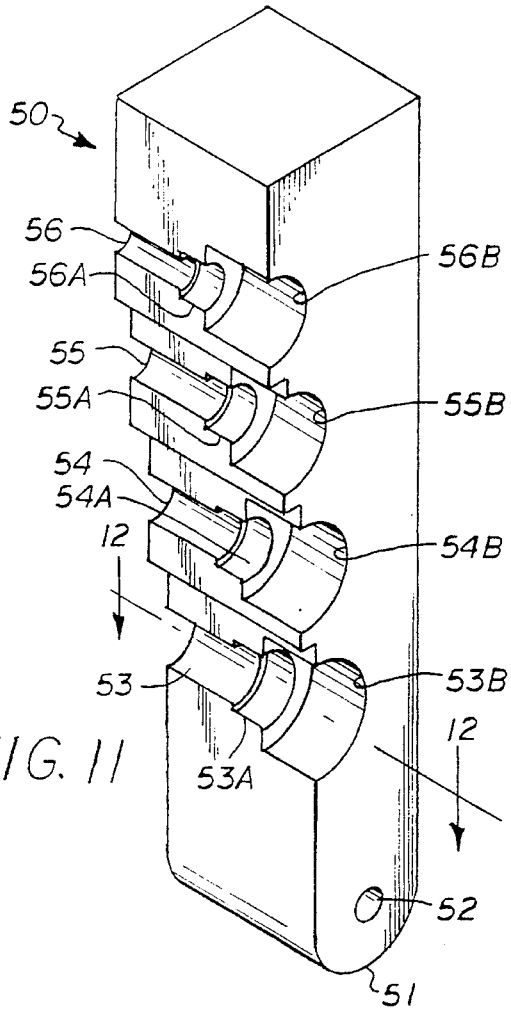
FIG. 11 is an isometric view of a backup tool which is clamped to the bending die for certain bending operations.

A backup tool 50, as shown in FIGS. 11 and 12, may be used when bending workpieces of thin wall or lightweight material. The backup tool 50 is a rectangular member having rounded bottom end 51 with a transverse hole 52 therethrough and a series of parallel channels 53, 54, 55, and 56 which extend transversely across the upper portion of the in vertically spaced relation. The channels 53–56 are semi-circular in vertical cross section and the inward facing radius of the channels are sized to receive the exterior surface of different diameter workpieces, and correspond to annular channel of the respective size bending die 36 for the workpiece to be bent.

As best seen in FIG. 12, each channel 52–56 is provided with a first counterbore 53A–56A and a second larger counterbore 53B–56B extending inwardly from one end coaxial with the respective channel 53–56 to define a first semi-circular counterbore having a radius slightly larger than the radius of the annular channel, and a second semi-circular counterbore having a radius larger than the first counterbore.

Figure 13:
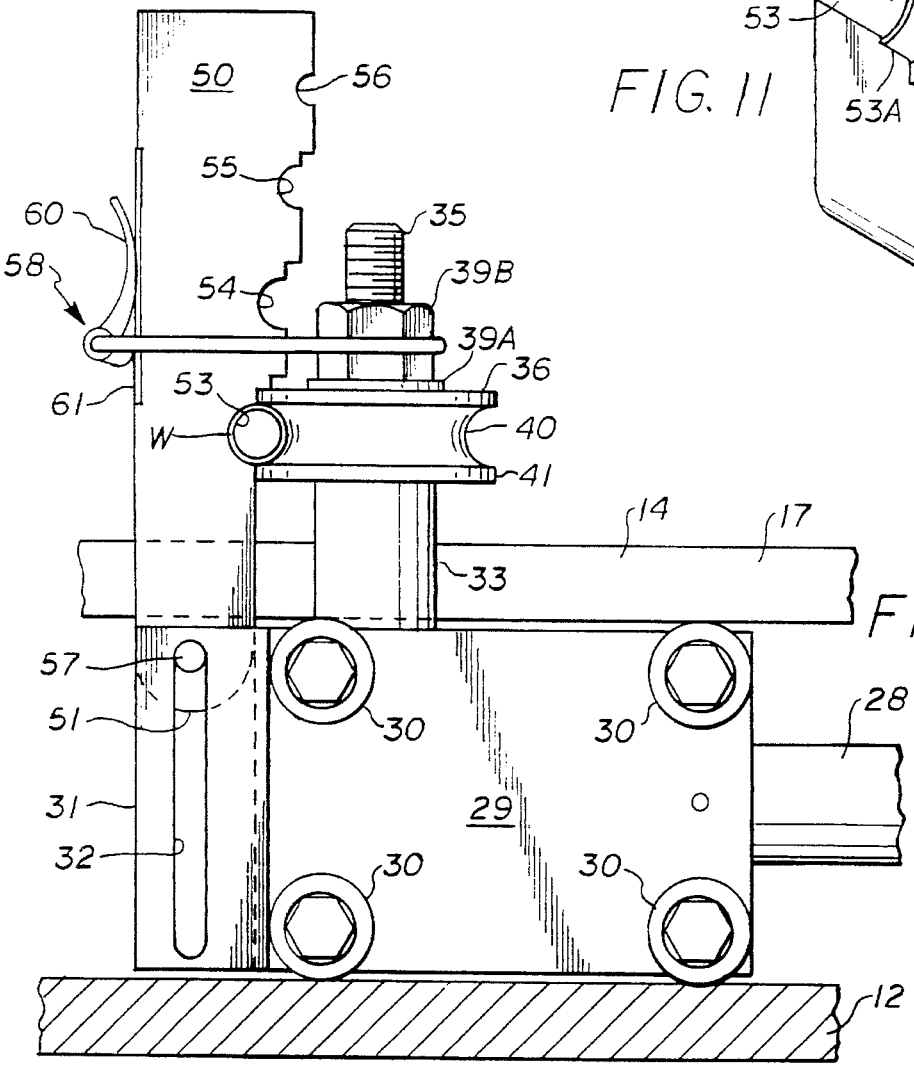
FIG. 13 is a side view of the carriage and bending die showing the backup tool clamped to the bending die.

Referring now to FIG. 13, the lower end of the backup tool 50 is slidably received in the vertical yoke 31 at the forward end of the carriage 29 and is retained therein by a pin 57 which extends transversely through the hole 52 and the vertical slots 32 in the side walls of the yoke 31. The backup tool 50 is raised until the appropriate channel (53 for example) is aligned with the annular channel 40 of the bending die 36. The backup tool 50 is then secured to the bending die 36 by a clamping apparatus 58. The clamping apparatus 58 has a U-shaped loop 59 of wire rod which fits around the nut 39B that secures the bending die on the vertical post 33. The outer ends of the loop 59 are connected to a cam action lever 60 which forces a rectangular plate 61 against the flat surface of the upper portion of the backup tool 50 and clamps the opposed facing surfaces of the backup tool and the bending die together. When engaged on a workpiece, the opposed semi-circular channels 40 and 53 of the bending die 36 and backup tool 50, respectively, completely surround the circumference of the workpiece. When not used, the backup tool 50 may removed from the yoke 31 by removing the pin 57.

Figure 14:
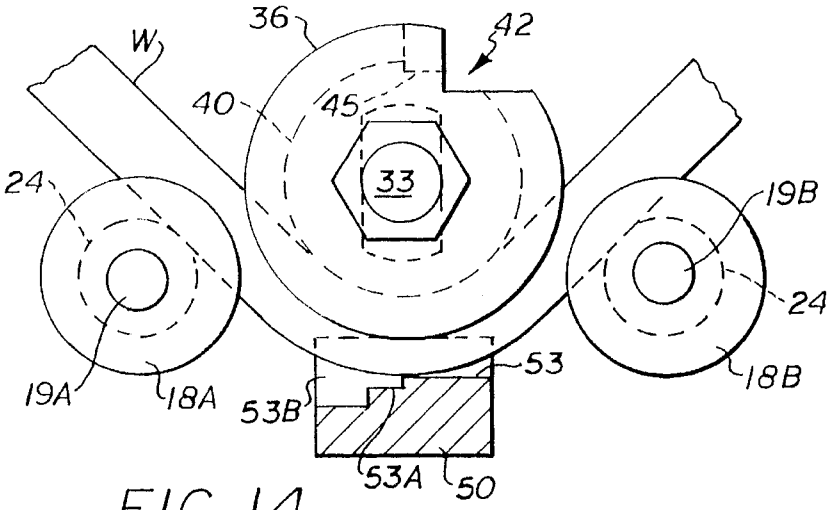
FIG. 14 is a top view illustrating schematically the backup tool clamped to the bending die in forming a bend in a workpiece.

As shown somewhat schematically in FIG. 14, when using the backup tool 50 and two lateral rollers 18A and 18B, the workpiece W is clamped to the bending die 36 and the piston rod is extended to advance the bending die between the lateral rollers 18A and 18B. As the bending die 36 advances between the rollers, the workpiece is received in the channels 24 of the lateral rollers and the workpiece begins to bend. When the bending die is fully advanced between the lateral rollers, the workpiece will have been bent a full 180°. The advancement of the bending die may be stopped prior to full extension for forming bends of less than 180°. The channels 40 and 53 of the bending die 36 and backup tool 50, respectively, form a circle around the workpiece W, and reduce crimping by preventing vertical expansion of the side wall of the tubular workpiece during the bend.

Figure 15:
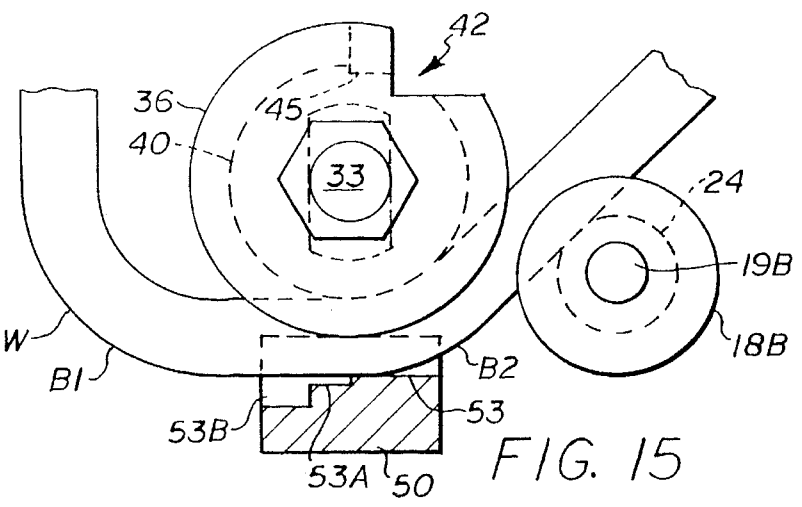
FIG. 15 is a top view illustrating schematically the backup tool clamped to the bending die in making close 90° bends with one of the lateral rollers removed.

As shown in FIG. 15, in making close 90° bends, one of the lateral rollers can be removed and the backup tool 50 is installed as described above to clamp the workpiece W to the bending die 36 at a position very close to a previous bend B1. The bending die 36 is then advanced to engage the straight section of the workpiece in the channel 24 of the single roller 18B and the workpiece begins to bend. When center of the bending die is advanced to the center of the roller, the workpiece will have been bent 90°.

Figure 16:
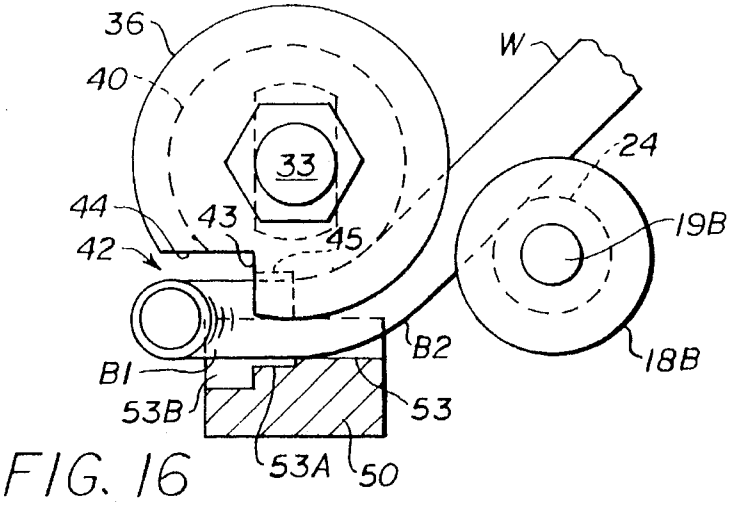
FIG. 16 is a top view illustrating schematically the backup tool clamped to the bending die in making close transition bends using a single roller.

As shown in FIG. 16 the pipe bending apparatus can also be used to make very close transition bends using a single roller, for example where a bend in a horizontal plane is to be made closely adjacent a bend in a vertical plane. To accomplish this, the bending die 36 is removed, rotated 180° and mounted on the post 33 with the cut-out portion 42 facing forward (away from the ram). The workpiece W is placed in the bending die annular channel 40 with the previously bent portion B1 received in the cut-out portion 42 and positioned vertically or at the desired angle relative to horizontal. The backup tool 50 is installed as described above to clamp the workpiece to the bending die at a position very close to the previous bend B1. The bending die is then extended to engage the straight section of the workpiece in the channel 24 of the roller 18B and the workpiece begins to bend. When the center of the bending die is advanced to the center of the roller, the workpiece will have been bent 90°. The advancement of the bending die may be stopped prior to full extension for forming bends of less than 90°.

Figure 17:
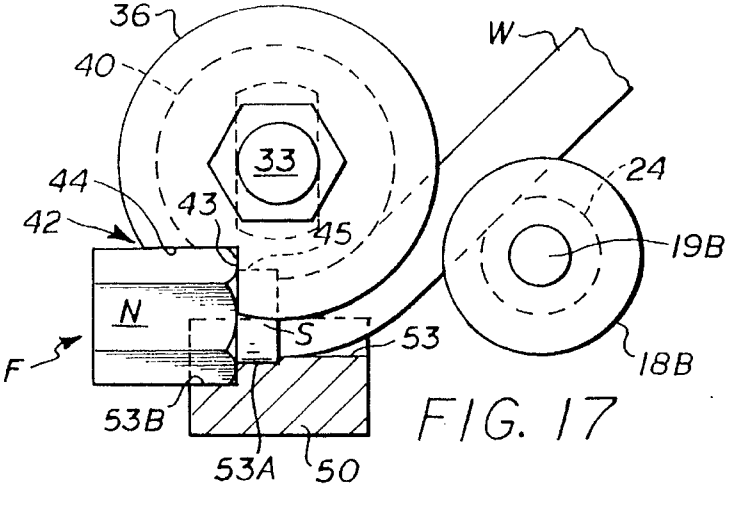
FIG. 17 is a top view illustrating schematically the backup tool clamped to the bending die in making bends very close to the end of a section of tubing which has a sleeved flared fitting and nut using a single roller.

As shown in FIG. 17, the pipe bending apparatus can also be used to make bends of up to 90° very close to the end of a section of tubing which has a sleeved flared fitting and nut using a single roller. This is accomplished by mounting the bending die 36 on the post 33 with the cut-out portion 42 facing forward (away from the ram). The workpiece W is placed in the bending die annular channel 40 with the sleeve S of the flared fitting F received in the counterbore 45 and a flat side of the nut N received on the flat surface 44. The backup tool 50 is clamped to the bending die as described above with the other half of the sleeve S received in the first counterbore 53A and the nut N of the flared fitting surrounded by the second counterbore 53B of the backup tool. The bending die 36 is then advanced to engage the straight section of the workpiece in the channel 24 of the roller 18B and the workpiece begins to bend. When center of the bending die is advanced to the center of the roller, the workpiece will have been bent 90°. The advancement of the bending die may be stopped prior to full extension for forming bends of less than 90°. The channels of the backup tool and bending die form a circle around a short section of the workpiece and sleeve to reduce vertical expansion and crimping, and the nut is secured during the bend.

Depending upon the wall thickness and material of the workpiece, there may be a tendency for the bent pipe, tubing, or rod to "springback" after the hydraulic pressure is released, resulting in less accuracy of the finished bend angle.

Figure 19:
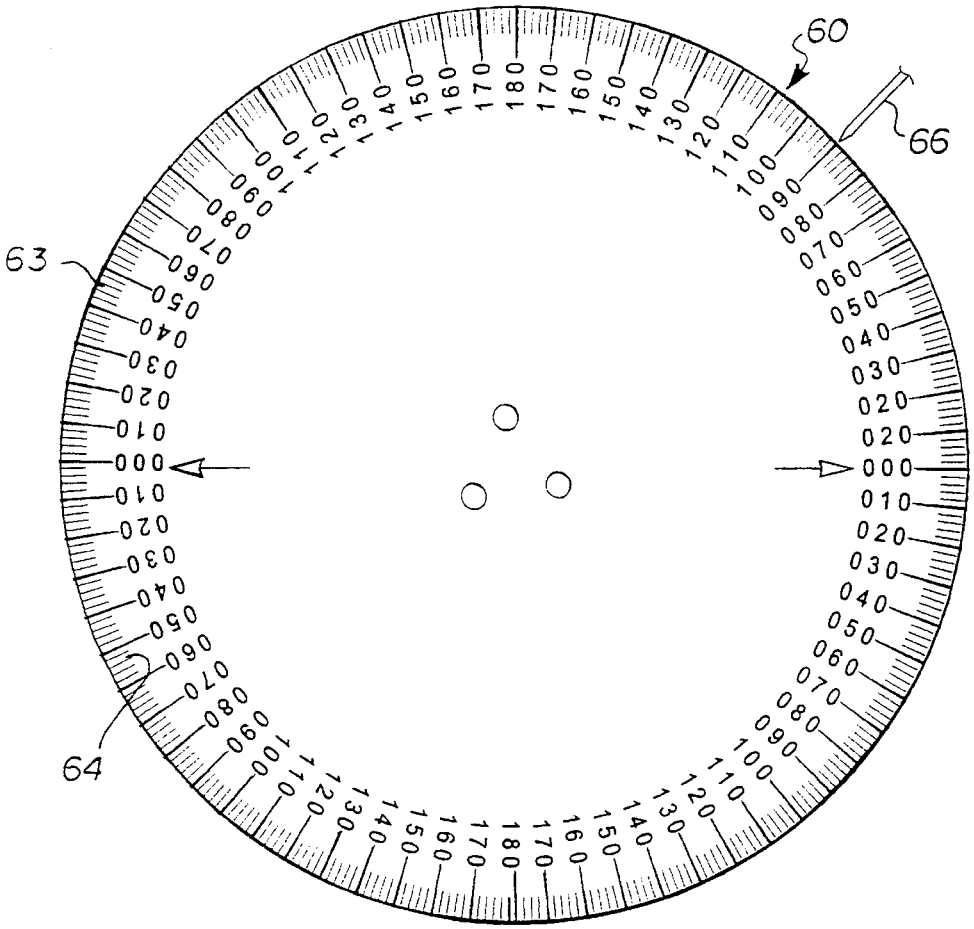
FIG. 19 is a top plan view of the indicator disc showing a circular scale.
Figure 18:
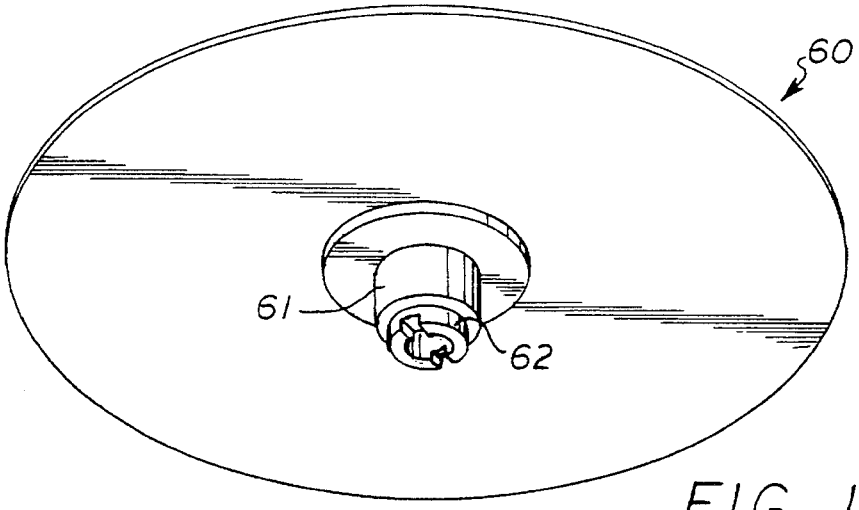
FIG. 18 is an isometric view of a circular indicator disc shown from the underside.
Figure 20:
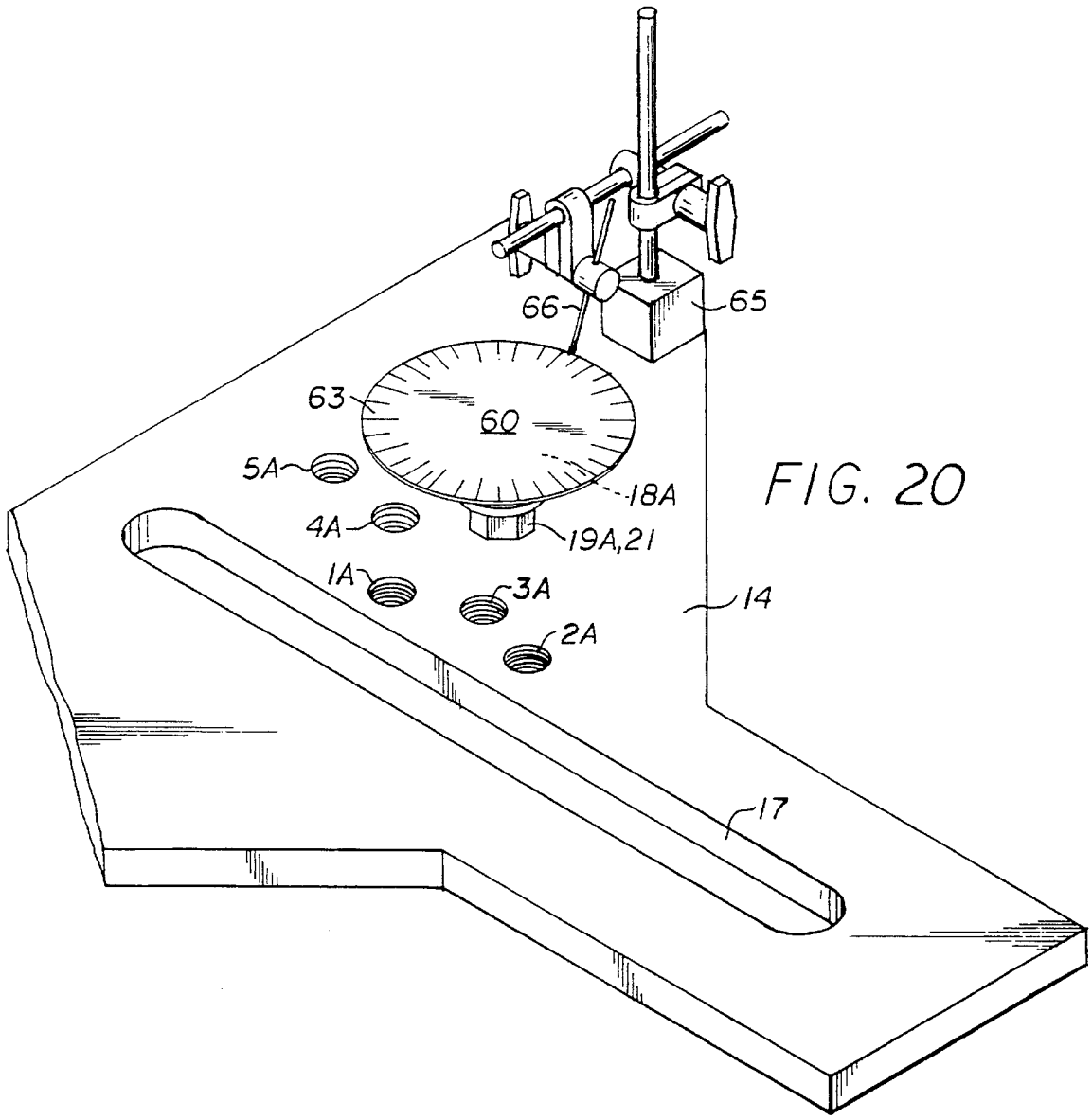
FIG. 20 is a partial isometric view of the indicator disc installed on a lateral roller and a pointer holder attached to the top plate of the tube bending apparatus.

FIGS. 18, 19 and 20 show a circular indicator disc 60 which has a short vertical tubular collar 61 centrally disposed on its underside. A tubular magnet 62 is secured inside the collar 61. The indicator disc 60 is placed onto one of the lateral pins 19A or 19B with the bore of the magnet slidably received around the upper portion 22 of the pin and the bottom end of the magnet is engaged magnetically on the top surface of the lateral roller 18A or 18B such that the indicator disc 60 rotates with the roller. The top side of the indicator disc 60 has a circular scale 63 imprinted thereon near its outer periphery. The scale 63 is divided into a series of small circumferentially spaced short radial lines 64. The spacing of the lines 64 is calculated to represent the fractions of the angle of the bend of the workpiece relative to the rotation of a roller of particular diameter.

In the illustrated embodiment (FIG. 19) the circular scale 63 is divided into four quadrants by two lines 180° apart labeled "000" which represent zero bend angle, two lines at 90° relative to the "000" lines labeled "180" representing a bend angle of 180° with lines between the "000" and "180" lines labeled "010 through "170" for a total of thirty-six labeled segments each representing a bend angle of 0.010 of a degree. Each of the short lines between the labeled segments represent a bend angle of 0.001 of a degree.

To use the indicator disk 60 the tubular workpiece W is held between the lateral rollers 18A and 18B in the channels 24 and the piston rod is extended to advance the bending die 36 against the workpiece and then stopped. The indicator disc 60 is placed onto one of the lateral pins 19A with the bore of the magnet slidably received around the upper portion 22 of the pin and the bottom end of the magnet is engaged magnetically on the top surface of the lateral roller 18A. As seen in FIG. 20, a conventional magnetic base indicator holder 65 is magnetically attached to the top plate 14 of the frame. The magnetic base indicator holder 65 has a vertical rod with a horizontal rod adjustably connected thereon by a clamp and thin pointer 66 is adjustably carried at the outer end of the horizontal rod by a second clamp.

The workpiece is held between the channels of the bending die and lateral rollers, as previously described, and the end of the pointer 66 is moved closely adjacent the scale 63 on the indicator disc 60 and locked into position and the indicator disc 60 is rotated to place one of the lines labeled "000" adjacent the end of the pointer. Thus, the workpiece is "zeroed out" and the scale indicates a zero bend angle. The ram is then operated to advance the bending die 36 between the rollers, and the workpiece begins to bend. As the workpiece advances and begins to bend, the rollers 18A and 18B rotate in opposite directions about the pins 19A and 19B. The indicator disc 60 rotates with the roller 18A and the scale 63 indicates the amount of the bend angle that is being formed in the workpiece based on the amount of rotation of the roller.

For example, if the bending die is advanced until its center is aligned with the center of the lateral rollers, the workpiece will have been bent approximately 90° and the roller would have made one-eighth of a revolution, and the scale would indicate a bend angle of "090". If the bending die is fully advanced between the lateral rollers, the workpiece will have been bent a full 180° and the roller would have made one-quarter of a revolution, and the scale would indicate a bend angle of "180".

After the desired bend angle has been made, as indicated by the indicator disc 60, the pressure on the ram is released. If the workpiece tends to "springback" or straighten out after the hydraulic pressure is released, the movement of the workpiece will rotate the roller in the opposite direction, and the amount of springback will be indicated on the scale. For example, if after a 90° bend has been made and the scale reading is "085" after the pressure is released, the actual bend angle is 85°.

With the workpiece still in position, the operator can then apply hydraulic pressure to the ram to advance the bending die until the scale reading is "095" and the pressure on the ram is again released. Now, when the workpiece springs back, the actual bend angle should be a true 90°. This step may be repeated if necessary to accomplish the desired bend angle.

Although a hydraulic ram has been shown and described in the example of the preferred embodiment, it should be understood that other power means may be used to advance and retract the bending die relative to the lateral rollers. For example, an elongate threaded drive screw may be rotatably mounted on the frame beneath the top plate and connected at one end to the carriage and at its opposite end to a hand crank or motor.

While this invention has been described fully and completely with special emphasis upon a preferred embodiment, it should be understood that within the scope of the appended claims the invention may be practiced otherwise than as specifically described herein.

I claim:

1. An apparatus for bending a tubular workpiece comprising an elongate frame having an upper surface with a longitudinally extending slot formed therein, a pair of vertical pins removably mounted on said upper surface, one on each side of said slot, two lateral circular rollers one rotatably mounted on each said pin in a horizontal plane above said upper surface and each having an annular circumferential channel semi-circular in cross section to receive the exterior surface of said tubular workpiece and surround approximately one-half of the circumference of said workpiece, a carriage member slidably mounted beneath said upper surface underlying said slot, a vertical post mounted on said carriage member and having an upper end extending through said slot, a generally circular bending die removably mounted on the upper end of said post in a horizontal plane above said upper surface and having an annular circumferential channel semi-circular in cross section to receive the exterior surface of said tubular workpiece and surround approximately one-half of the circumference of said workpiece, a reciprocating power means mounted lengthwise along a reciprocating axis beneath said upper surface to advance and retract said bending die relative to said lateral rollers, said lateral rollers and said bending die being the only members disposed on a horizontal plane spaced vertically above said upper surface and said reciprocating axis being disposed on a horizontal plane beneath said upper surface a sufficient distance to provide an unobstructed work area surrounding said lateral rollers and said bending die through which at least one free end of the tubular workpiece may pass when being bent, whereby a section of a tubular workpiece held against said lateral rollers can be engaged by said bending die and bent into a curved configuration and a plurality of adjacent bends lying in the same plane or different planes may be made in said workpiece and a previously bent section will pass through the unobstructed work area and not strike said rollers, said bending die, and said reciprocating power means.

2. The apparatus according to claim 1 including indicator means for removable connection to one of said lateral rollers to rotate therewith and having a scale imprinted thereon, said scale divided into a series of markings representing fractions of the angle of the bend of the workpiece relative to the rotation of the roller on which it is connected, and adjustable pointer means for removable connection to said frame adapted to be fixed adjacent said scale markings, whereby said pointer means and said scale are positioned to indicate a zero bend angle when said section of said tubular workpiece is held against said lateral rollers and is engaged by said bending die prior to being bent into a curved configuration and said indicator rotates with said roller on which it is connected relative to said pointer when said bending die is advanced relative to said lateral rollers to bend said tubular workpiece to indicate the bend angle being formed, and to indicate the bend angle after completion of the bend.

3. An apparatus for bending a tubular workpiece comprising:

an elongate frame having a top plate with an upper surface and a longitudinally extending slot formed therein;

a first and second set of mounting holes formed in said top plate, one set on each side of said longitudinally extending slot, each hole in said first set being positioned laterally across from a corresponding hole in said second set;

a pair of vertical pins, one removably mounted in one of said holes of said first set and the other removably mounted in a corresponding one of said holes of said second set in laterally spaced relation, one on each side of said slot;

a plurality of pairs of lateral circular rollers each having an annular circumferential channel semi-circular in cross section to receive the exterior surface of a said tubular workpiece of a particular diameter and surround approximately one-half of the circumference of said workpiece, each pair of rollers having identifying means thereon correlated to the size of their respective annular channels, one of said rollers of a selected pair rotatably mounted on each said pin in a horizontal plane above said upper surface;

a carriage member slidably mounted beneath said upper surface underlying said slot;

a vertical post mounted on said carriage member and having an upper end extending through said slot;

a plurality of generally circular bending dies each having an annular circumferential channel semi-circular in cross section to receive the exterior surface of said tubular workpiece of particular diameter and surround approximately one-half of the circumference of said workpiece, a selected one of said bending dies removably mounted on the upper end of said post in a horizontal plane above said upper surface;

a reciprocating power means mounted lengthwise along a reciprocating axis beneath said upper surface to advance and retract said bending die relative to said lateral rollers;

each corresponding pair of holes being laterally spaced apart a predetermined distance correlated to the diameter of various tubular workpieces, the radius of the annular channel of various pairs of said lateral rollers, and the radius of the annular channel of various said bending dies, and each corresponding pair of holes of said first and second sets of holes having indicia adjacent thereto corresponding to the identifying means on said lateral rollers whereby an operator may select the appropriate bending die of said plurality and said corresponding pair of said lateral rollers and mount said lateral rollers at the proper spacing to produce a predetermined bend in a tubular workpiece of a particular diameter; and said pair of lateral rollers and said bending die being disposed on a horizontal plane spaced vertically above said upper surface and said reciprocating axis being disposed on a horizontal plane beneath said upper surface a sufficient distance to provide a substantially unobstructed work area surrounding said pair of lateral rollers and said bending die through which at least one free end of said tubular workpiece may pass when being bent and not strike said lateral rollers, said bending die, and said reciprocating power means.

4. An apparatus for bending a tubular workpiece comprising an elongate frame having an upper surface with a longitudinally extending slot formed therein, a vertical pin removably mounted on said upper surface on one side of said slot, a circular roller rotatably mounted on said pin in a horizontal plane above said upper surface and having an annular circumferential channel semi-circular in vertical cross section to receive the exterior surface of said tubular workpiece and surround approximately one-half of the circumference of said workpiece, a carriage member slidably mounted beneath said upper surface underlying said slot, a vertical post mounted on said carriage member and having an upper end extending through said slot, a generally circular bending die removably fixed on the upper end of said post on a horizontal plane above said upper surface and having an annular generally circumferential channel semi-circular in vertical cross section to receive the exterior surface of said tubular workpiece and surround approximately one-half of the circumference of said workpiece, a reciprocating power means mounted lengthwise along a reciprocating axis beneath said upper surface to advance and retract said bending die relative to said roller, and clamping means for releasable connection to said bending die and having a channel semi-circular in vertical cross section positioned opposite a portion of said bending die annular generally circumferential channel to receive and surround approximately one-half of the circumference of the workpiece which is received in said bending die annular channel, whereby a section of the circumference of said tubular workpiece is clamped to said bending die and completely surrounded by the opposed channels of said clamping means and said bending die, and when said bending die is advanced relative to said lateral rollers an outwardly disposed section of said tubular workpiece is engaged in the annular channel of said roller and said workpiece is bent into a curved configuration.

5. The apparatus according to claim 4 in which said bending die has a peripheral opening extending inwardly from its circumference and through its said annular channel, said bending die is removably fixed on an upper end of said post with said peripheral opening and a laterally adjacent curved section of its said annular channel facing away from said power means, a previously bent section of said tubular workpiece is received in said bending die peripheral opening in an outwardly extending position and an adjacent section of said tubular workpiece is received on said laterally adjacent curved section of said bending die and clamped thereto to extend outwardly in a generally horizontal position, whereby when said bending die is advanced relative to said roller the generally horizontally extended section of said tubular workpiece is engaged in the annular channel of said roller and said workpiece is bent into a curved configuration in a plane different from said previously bent section.

6. The apparatus according to claim 4 in which said bending die peripheral opening is defined by a generally L-shaped opening having a first flat surface extending inwardly a distance from its outer circumference past the inward facing radius of said annular channel and a second flat surface extending laterally outward to one side at a right angle to said first flat surface.

7. The apparatus according to claim 4 in which said clamping means channel is counterbored to receive and surround approximately one-half of the circumference of a sleeve and nut of a flared fitting at one end of said workpiece which is received in said bending die annular channel, said bending die annular channel is counterbored adjacent its said peripheral opening to receive and surround approximately one-half of the circumference of said sleeve, and said peripheral opening is configured to receive said nut of said flared fitting, a short section of said tubular workpiece and said sleeve of said flared fitting is completely surrounded by the opposed channels of said clamping means and said bending die, and said nut of said flared fitting is received in said bending die peripheral opening in an outwardly extending position and a short section of said tubular workpiece adjacent said sleeve is received on said laterally adjacent curved section of said bending die and clamped thereto to extend outwardly in a generally horizontal position, whereby when said bending die is advanced relative to said roller the generally horizontally extended section of said tubular workpiece is engaged in the annular channel of said roller and the workpiece is bent into a curved configuration closely adjacent said sleeve of said flared fitting.

* * * * *